US010619297B2

(12) United States Patent
Calvet et al.

(10) Patent No.: US 10,619,297 B2
(45) Date of Patent: Apr. 14, 2020

(54) UNIT FOR PRODUCING AN ASSEMBLY

(71) Applicant: COMPAGNIE GENERALE DES ETABLISSEMENTS MICHELIN, Clermont-Ferrand (FR)

(72) Inventors: Marc Calvet, Clermont-Ferrand (FR); Henri Barguet, Clermont-Ferrand (FR); Francis Aubarede, Clermont-Ferrand (FR)

(73) Assignee: Compagnie Generale des Etablissements Michelin, Clermont-Ferrand (FR)

( * ) Notice: Subject to any disclaimer, the term of this patent is extended or adjusted under 35 U.S.C. 154(b) by 150 days.

(21) Appl. No.: 15/571,149

(22) PCT Filed: May 26, 2016

(86) PCT No.: PCT/EP2016/061876
§ 371 (c)(1),
(2) Date: Nov. 1, 2017

(87) PCT Pub. No.: WO2016/189074
PCT Pub. Date: Dec. 1, 2016

(65) Prior Publication Data

US 2018/0171551 A1 Jun. 21, 2018

(30) Foreign Application Priority Data

May 26, 2015 (FR) ..... 15 54700

(51) Int. Cl.
*D07B 7/02* (2006.01)
*D07B 1/06* (2006.01)
(Continued)

(52) U.S. Cl.
CPC ..... *D07B 7/025* (2013.01); *D02G 3/48* (2013.01); *D07B 1/0613* (2013.01);
(Continued)

(58) Field of Classification Search
CPC .... D07B 1/0646; D07B 1/0653; D07B 7/025; D07B 2207/202; D07B 2207/203;
(Continued)

(56) References Cited

U.S. PATENT DOCUMENTS 3,142,145 A * 7/1964 Blanchard ..... D07B 1/0693 57/311
3,388,541 A * 6/1968 Biagini ..... D07B 7/14 57/9
(Continued)

FOREIGN PATENT DOCUMENTS

DE 40 19 584 A1 1/1991
EP 0 143 767 A1 6/1985
(Continued)

OTHER PUBLICATIONS

Aug. 22, 2016 International Search Report and Written Opinion in International Patent Appln. No. PCT/EP2016/061876.

*Primary Examiner* — Shaun R Hurley
*Assistant Examiner* — Patrick J. Lynch
(74) *Attorney, Agent, or Firm* — Venable LLP

(57) ABSTRACT

An apparatus for producing an assembly of filamentary elements that are wound together in a helix includes a twisting device, a preforming device, and an assembling device. The twisting device is structured to twist at least first and second filamentary elements individually, such that each filamentary element is twisted separately from another filamentary element, to produce at least first and second twisted filamentary elements. The preforming device, which is arranged downstream of the twisting device, is structured to preform each of the twisted filamentary elements individually into separate preformed helixes, to produce at least first and second preformed helixes. The assembling device, which is arranged downstream of the preforming device, is
(Continued)

structured to assemble the preformed helixes into an assembly.

22 Claims, 4 Drawing Sheets

(51) Int. Cl.
*D07B 7/04* (2006.01)
*D07B 3/00* (2006.01)
*D02G 3/48* (2006.01)

(52) U.S. Cl.
CPC ..... *D07B 1/0626* (2013.01); *D07B 1/0646* (2013.01); *D07B 3/00* (2013.01); *D07B 7/04* (2013.01); *D07B 2201/2002* (2013.01); *D07B 2201/2003* (2013.01); *D07B 2201/2008* (2013.01); *D07B 2201/2016* (2013.01); *D07B 2201/2021* (2013.01); *D07B 2201/2022* (2013.01); *D07B 2207/205* (2013.01); *D07B 2207/4018* (2013.01); *D07B 2207/4072* (2013.01); *D07B 2401/201* (2013.01); *D07B 2401/406* (2013.01); *D07B 2501/2046* (2013.01)

(58) Field of Classification Search
CPC ..... D07B 2207/204; D07B 2207/205; D07B 2207/20; D07B 2207/207; D07B 2207/4022; D07B 2207/4018; D07B 2207/4072
USPC ..... 57/311
See application file for complete search history.

(56) References Cited

U.S. PATENT DOCUMENTS

| | | | | |
|---|---|---|---|---|
| 4,566,261 | A | 1/1986 | Brandyberry et al. | 57/212 |
| 4,604,861 | A * | 8/1986 | Matsuura | D07B 1/0693 57/311 |
| 4,641,689 | A * | 2/1987 | Christian | D07B 3/00 140/149 |
| 4,757,700 | A | 7/1988 | Dotti et al. | 72/66 |
| 4,887,421 | A | 12/1989 | Haislet | 57/58.54 |
| 5,533,327 | A | 7/1996 | Albert | 57/311 |
| 5,707,467 | A | 1/1998 | Matsumaru et al. | 152/527 |
| 5,722,226 | A * | 3/1998 | Matsumaru | B60C 9/0007 57/138 |
| 6,016,647 | A * | 1/2000 | Kawatani | D07B 1/0653 57/12 |
| 2009/0260735 | A1* | 10/2009 | Sasabe | B60C 15/04 152/540 |
| 2015/0136295 | A1 | 5/2015 | Barguet et al. | B60C 9/0007 |
| 2015/0159325 | A1 | 6/2015 | Barguet et al. | D07B 5/12 |
| 2017/0321352 | A1 | 11/2017 | Calvet et al. | |
| 2017/0321376 | A1 | 11/2017 | Calvet et al. | |

FOREIGN PATENT DOCUMENTS

| | | | |
|---|---|---|---|
| JP | S 58-107240 | A | 6/1983 |
| JP | H 02-269885 | A | 11/1990 |
| JP | H 04-308288 | A | 10/1992 |
| JP | 2009-079313 | A | 4/2009 |

* cited by examiner

UNIT FOR PRODUCING AN ASSEMBLY

FIELD OF THE INVENTION

The invention relates to a unit for producing an assembly of filamentary elements.

RELATED ART

A heavy-duty-vehicle tire comprising a radial carcass reinforcement is known from the prior art. Such a tire comprises a radial carcass reinforcement that is anchored in two beads and surmounted radially by a crown reinforcement that is itself surmounted by a tread that is joined to the beads by two sidewalls.

In such a tire, the crown reinforcement comprises a working reinforcement, a hoop reinforcement, a protective reinforcement and, optionally, a triangulation reinforcement. The relative arrangement of these reinforcements relative to one another may vary. In general, the protective reinforcement is the radially outermost reinforcement, the working reinforcement is the radially innermost reinforcement, the hoop reinforcement being arranged between the protective reinforcement and the working reinforcement.

Each reinforcement comprises a single or several plies. Each ply comprises reinforcing elements arranged side-by-side parallel to one another. The reinforcing elements make an angle that varies according to the reinforcement to which the ply belongs. Each reinforcing element comprises one or more assemblies of filamentary elements, each assembly comprising several individual metal threads assembled with one another either by cabling or by twisting.

An assembly of filamentary elements comprising a single layer of filamentary elements, in this instance three threads, of a diameter of 0.26 mm wound together in a helix with a pitch of 5 mm is known from the prior art. This assembly is designated by the term "3.26" according to the usual terminology.

In order to ensure correct operation of each reinforcement, and notably of the hoop and protective reinforcements, it is desirable to be able to control the structural elongation of these assemblies of filamentary elements and more particularly to be able to obtain a structural elongation that is high when that proves necessary. The use of a conventional twisting method makes it possible to obtain a structural elongation at most equal to 0.5% for the 3.26 cord described hereinabove.

In order to increase the value of the structural elongation, the prior art discloses several methods and units for producing an assembly of filamentary elements comprising a single layer of several filamentary elements wound together in a helix. Such methods and units are notably described in document EP0143767. In these methods, in order to obtain the highest possible structural elongation, the filamentary elements are individually preformed, then the preformed filamentary elements are assembled by cabling.

To this end, the unit comprises means for feeding and means for individually preforming each thread, which means are arranged in a rotating pod positioned upstream of the point at which the filamentary elements are assembled with one another. The heavier the feed and preforming means, the more robustly the pod needs to be dimensioned so that it can mechanically withstand the inertia generated by the mass of the assembly comprising the pod, the feed means and the preforming means. In order to limit this inertia, it therefore becomes necessary to operate at rotational speeds that are relatively low, and this limits the productivity of the unit.

Furthermore, this step of preforming the filamentary elements does not make it possible to achieve high structural elongations. Specifically, the use of an assembly method using a step of preforming the filaments makes it possible to obtain a structural elongation at most equal to 2.0% for the 3.26 cord described hereinabove.

BRIEF DESCRIPTION OF EMBODIMENTS OF THE INVENTION

It is an object of the invention to obtain assemblies of filamentary elements exhibiting a high structural elongation and to do so by using a unit that is more productive than that of the prior art.

To this end, one subject of the invention is a unit for producing an assembly of filamentary elements bound together in a helix comprising:

means of twisting at least first and second filamentary elements, arranged in such a way as to twist the first and second filamentary elements separately from one another, means of preforming at least the first and second twisted filamentary elements into a helix, arranged downstream of the twisting means and so as to preform the twisted first and second filamentary elements separately from one another, means of assembling at least the first and second twisted and preformed filamentary elements, arranged downstream of the preforming means and in such a way as to form the assembly of filamentary elements.

By virtue of the unit according to the invention it is possible, should it prove necessary to do so, to obtain a relatively high structural elongation and to do so with a relatively high productivity.

Specifically, by virtue of the means of assembly by twisting, there is no need for the means situated upstream of the assembly point to be arranged in a rotating pod, contrary to the case with assembly by cabling. The means of assembly of the unit according to the invention can therefore be dimensioned independently of the speed of assembly. Thus, relatively high-capacity (and therefore relatively heavy) feed means can be used for each filamentary element, thereby allowing the unit to need to be stopped less frequently.

Furthermore, the preforming and twisting means may be dimensioned independently of one another, notably as regards their bulk and their mass. Unlike a unit comprising means of assembly by cabling, in which unit the mass and the bulk of the means situated upstream of the assembly point need to be as low as possible, the unit according to the invention makes it possible to use wide varieties of means without being limited by the bulk or mass of the preforming and twisting means.

Finally, since the means of individually twisting each filamentary element are arranged upstream of the means of individual preforming, it does not influence the curvature of the filamentary elements which is obtained during and after the preforming step using the means of individual preforming. Specifically, because the step of individual preforming takes place downstream of the step of individual twisting, the twisting cannot eliminate the helix created subsequently by the preforming. The assemblies obtained after the assembly step have significant aeration connected with the maintaining of the curvature of the preformed filamentary elements. This aeration makes it possible to obtain assemblies that exhibit significant structural elongation should that prove to be necessary.

Contrary to the prior art in which the filamentary elements are assembled by cabling, and in which the filamentary elements do not experience twist about their own axis (because of a rotation that is synchronous before and after the assembly point), the unit according to the invention comprises means of individually twisting each filamentary element allowing each filamentary element to experience individual twist about its own axis. During this individual twisting, each filamentary element is plastically deformed and a residual twist is generated within each filamentary element. Thus, during this step of individual twisting of each filamentary element, each filamentary element is then balanced by an un-twisting so as to cancel this residual twist. Thus, after the step of individual twisting and before the step of individual preforming, each filamentary element is twisted and balanced.

A filamentary element means any longilinear element of great length relative to its cross section, whatever the shape of the latter, for example circular, oblong, rectangular or square, or even flat, it being possible for this filamentary element to be twisted or wavy, for example. When it is circular, its diameter is preferably less than 3 mm.

What is meant by preforming into a helix is a three-dimensional helix inscribed inside a cylinder having a main axis defining the axis of the helix. The three-dimensional helix defines a path of which the projection onto a plane orthogonal to its helix axis is a circle and of which the projection onto a plane parallel to its helix axis is a sinusoid. For preference, the means of assembly comprise a distributor and an assembly guide.

Advantageously, the unit comprises means of maintaining the rotation of the assembly which are arranged downstream of the assembly guide.

In one embodiment, the means of assembly comprise a bow positioned downstream of the assembly guide.

For preference, the means of assembly comprise a pod arranged downstream of the assembly guide bearing means of storing the assembly.

Advantageously, the pod bears means of balancing the assembly.

Optionally, the unit comprises means of feeding at least the first and second filamentary elements arranged upstream of the twisting means.

In one embodiment, the assembly of filamentary elements comprises a single layer formed by the filamentary elements of the assembly. In this embodiment, the assembly has no central core around which the filamentary elements of the layer would be wound.

In another embodiment, the assembly of filamentary elements comprises a layer of filamentary elements wound together in a helix around a central core.

In an alternative form, the method comprises a step of assembling the layer of filamentary elements wound together in a helix around the central core in such a way that the central core exhibits substantially non-zero twist.

This alternative form is used notably in instances in which the central core is textile and the substantially non-zero twist has no impact on the twist balancing of the assembly. What is meant by substantially non-zero is that the core exhibits a twist greater than 10 turns per metre.

What is meant by textile is that the central core is non-metallic. The central core may then comprise a single elementary textile monofilament or alternatively several multifilament textile strands comprising several elementary textile monofilaments. In an alternative form, the transient center comprises a single multifilament strand referred to as an overtwist comprising several elementary monofilaments. In an alternative form, the transient center comprises several multifilament strands, each one referred to as an overtwist, each one comprising several elementary monofilaments and assembled together in a helix to form a plied yarn.

Advantageously, the or each textile material of each elementary textile monofilament is selected from a polyester, a polyamide, a polyketone, a polyvinyl alcohol, a cellulose, a mineral fibre, a natural fibre, or a mixture of these materials.

Examples of polyesters include polyethylene terephthalate (PET), polyethylene naphthalate (PEN), polybutylene terephthalate (PBT), polybutylene naphthalate (PBN), polypropylene terephthalate (PPT) or polypropylene naphthalate (PPN). Examples of polyamides include an aliphatic polyamide such as nylon or an aromatic polyamide such as aramid. Examples of polyvinyl alcohols include Kuralon®. Examples of cellulose include rayon. Examples of mineral fibres include glass fibres and carbon fibres. Examples of natural fibres include hemp or flax fibres.

In an alternative form, the method comprises a step of assembling the layer of filamentary elements wound together in a helix around the central core in such a way that the central core exhibits substantially zero twist. This alternative form is used notably in instances in which the central core is metallic and the substantially non-zero twist would have a significant impact on the twist balancing of the assembly. What is meant by substantially zero is that the core exhibits a twist of less than 10 turns per metre.

Advantageously, the layer comprises between 2 and 9 filamentary elements, preferably between 5 and 9 filamentary elements. What is meant by between 2 and 9 filamentary elements is that the layer may comprise 2, 3, 4, 5, 6, 7, 8 or 9 filamentary elements. In an assembly of the prior art comprising at least 5 non-preformed filamentary elements, one of the filamentary elements is positioned at the center of the assembly. The invention advantageously makes provision to solve this problem regardless of the number of filamentary elements in the assembly.

As a preference, the helix angle of at least each first and second filamentary element is comprised between 10° and 25°. The helix angle is equal, in a plane of projection of the helix through which the longitudinal axis thereof passes, to the angle measured between the projection of the longitudinal axis onto the plane of projection and the tangent to the projection of the helix at the point of intersection of the projection of the helix and of the projection of the longitudinal axis.

As a preference, the pitch P of the helix of at least each first and second filamentary element is such that $P=k1 \cdot d$ in which d is the diameter of each first and second filamentary element, with k1 ranging from 15 to 50. The helix pitch P is equal to the distance, along the axis of the filamentary element, that is covered by a point on the neutral axis of the filamentary element after it has made one complete turn of the circle described by the neutral axis.

As a preference, the diameter D of the helix of at least each first and second filamentary element is such that $D=k2 \cdot d$ in which d is the diameter of each first and second filamentary element, with k2 ranging from 2 to 5. The helix diameter D is equal to the diameter of the circle described by the neutral axis F of each filamentary element. The helix diameter D can also be determined as being equal to the distance separating the centers of two filamentary elements that are diametrically opposed within the assembly A.

Such helix angles, pitches P and diameters D are compatible with use of the assembly in a tire.

In one embodiment, each first and second filamentary element is made up of a single elementary metallic monofilament.

In another embodiment, each first and second filamentary element is made up of a strand comprising several elementary metallic monofilaments. Thus, for example, each filamentary element comprises a strand of several elementary monofilaments. Each strand preferably comprises one or more layers of elementary monofilaments wound together in a helix.

In these two embodiments, each elementary monofilament is preferably metallic. By definition, metallic is understood to mean an elementary monofilament made up predominantly (i.e. more than 50% of its weight) or entirely (100% of its weight) of a metallic material. Each elementary monofilament is preferentially made of steel, more preferentially perlitic (or ferritic-perlitic) carbon steel referred to as "carbon steel" below, or else made of stainless steel (by definition steel comprising at least 10.5% chromium).

When a carbon steel is used, its carbon content (% by weight of steel) is preferably between 0.5% and 0.9%. Use is preferably made of a steel of the normal tensile (NT) or high tensile (HT) steel cord type, the tensile strength (Rm) of which is preferably greater than 2000 MPa, more preferentially greater than 2500 MPa and less than 3500 MPa (measurement carried out under tension according to standard ISO 6892-1, 2009).

In one preferred embodiment, the diameter of the or each elementary monofilament ranges from 0.05 mm to 0.50 mm, preferably from 0.10 mm to 0.40 mm, and more preferentially from 0.15 mm to 0.35 mm.

The invention makes it possible to produce an assembly of filamentary elements which are wound together in a helix.

Advantageously, the assembly of filamentary elements has a structural elongation greater than or equal to 3.0%, preferably 4.0%, and more preferably 5.0%, measured in accordance with standard ASTM A931-08.

The invention makes it possible to obtain a tire comprising an assembly of filamentary elements as defined hereinabove.

A tire such as this is notably intended to be fitted onto motor vehicles of the passenger type, SUVs ("Sport Utility Vehicles"), two-wheel vehicles (especially bicycles and motorcycles), aircraft, or industrial vehicles chosen from vans, "heavy-duty" vehicles—that is to say underground trains, buses, heavy road transport vehicles (lorries, tractors, trailers), off-road vehicles, such as agricultural or civil engineering machines—and other transport or handling vehicles.

For preference, the tire comprises a tread and a crown reinforcement arranged radially on the inside of the tread. The crown reinforcement preferably comprises a working reinforcement and a protective reinforcement, the protective reinforcement being interposed radially between the tread and the working reinforcement. In a preferred embodiment, with each protective ply comprising one or more reinforcing elements, referred to as protective reinforcing elements, each protective reinforcing element comprises an assembly as described hereinabove.

According to an optional feature of the tire, the protective reinforcing element or elements make an angle at least equal to 10°, preferably in the range from 10° to 35° and more preferentially from 15° to 35°, with the circumferential direction of the tire.

According to another optional feature of the tire, with each working ply comprising reinforcing elements known as working reinforcing elements, the working reinforcing elements make an angle at most equal to 60°, preferably in the range from 15° to 40°, with the circumferential direction of the tire.

In one preferred embodiment, the crown reinforcement comprises a hoop reinforcement comprising at least one hooping ply. In a preferred embodiment, with each hooping ply comprising one or more reinforcing elements, referred to as hoop reinforcing elements, each hoop reinforcing element comprises an assembly as described hereinabove.

According to an optional feature of the tire, the hoop reinforcing element or elements make an angle at most equal to 10°, preferably in the range from 5° to 10°, with the circumferential direction of the tire.

In a preferred embodiment, the carcass reinforcement is arranged radially on the inside of the crown reinforcement.

Advantageously, the carcass reinforcement comprises at least one carcass ply comprising reinforcing elements known as carcass reinforcing elements, the carcass reinforcing elements making an angle greater than or equal to 65°, preferably greater than or equal to 80° and more preferentially in the range from 80° to 90° with respect to the circumferential direction of the tire.

BRIEF DESCRIPTION OF THE DRAWINGS

The invention will be better understood from reading the following description, which is given solely by way of non-limiting example and with reference to the drawings in which.

DETAILED DESCRIPTION OF EMBODIMENTS OF THE INVENTION

Figure 1:
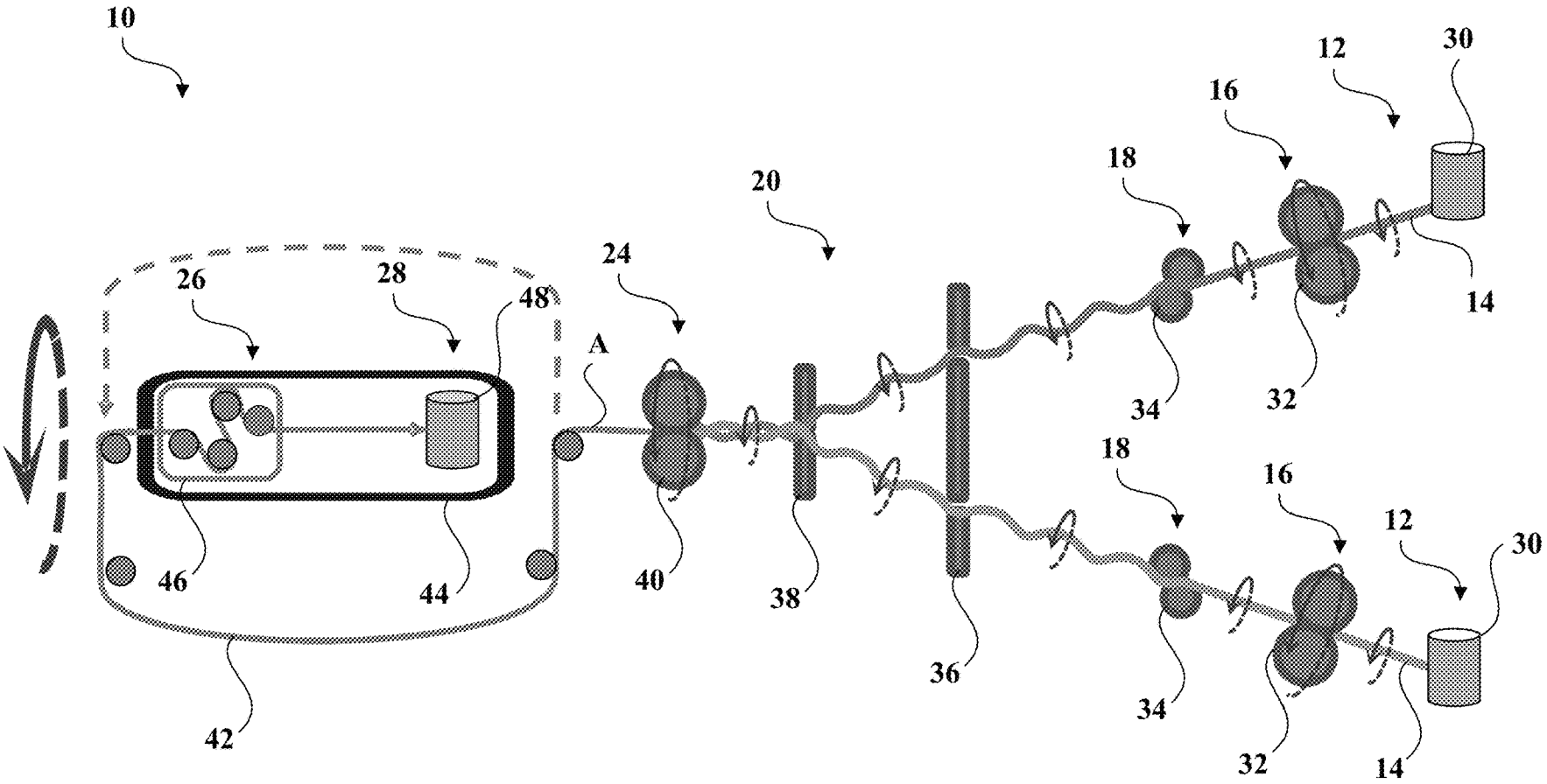
FIG. 1 is a diagram of a unit according to a first embodiment and making it possible to implement a method according to a first embodiment and to produce the assembly of FIG. 2.

FIG. 1 depicts a unit for producing an assembly A of filamentary elements wound together in a helix. This unit, according to the invention, is denoted by the overall reference 10.

The unit 10 comprises, from upstream to downstream when considering the direction in which the filamentary elements travel:

feed means 12 for feeding M filamentary elements 14,
twisting means 16 for individually twisting each filamentary element 14 and arranged in such a way as to twist each filamentary element 14 separately from one another
preforming means 18 for individually preforming each filamentary element 14 and arranged downstream of the twisting means and in such a way as to preform each twisted filamentary element 14 separately from one another,
means 20 of assembling the filamentary elements 14 together into a helix to form the assembly A and arranged downstream of the preforming means and in such a way as to form the assembly of filamentary elements,
means 24 of maintaining the rotation of the assembly A about its axis,
means 26 of balancing the assembly A, and
means 28 of storing the assembly A.

The unit 10 also comprises means of guiding, paying out, and applying tension to the filamentary elements and the assembly as conventionally used by those skilled in the art, for example pulleys and capstans.

The feed means 12 comprise a spool 30 holding each filamentary element. For the sake of clarity of the figures, these depict only two filamentary elements 14 and therefore only the corresponding means.

The means 16 of individually twisting each filamentary element 14 comprise a twisting device 32, also more commonly known to those skilled in the art as a "twister", for example a two-pulley twister.

The means 18 of individually preforming each filamentary element 14 comprise, for example, a roller-type preforming device 34 such as described in U.S. Pat. No. 5,533,327A or U.S. Pat. No. 4,566,261A.

The means of assembly 20 comprise a distributor 36 and, downstream of that, an assembly guide 38.

The means 24 of maintaining the rotation are arranged downstream of the assembly guide 38 and comprise a twister 40, for example a two-pulley twister making it possible to maintain the rotation of the assembly A respectively about the main direction of the assembly A.

Downstream of the means 24 of maintaining the rotation and of the assembly guide 38, the means of assembly 20 comprise a bow 42 and a pod 44 for carrying the balancing means 26 and the storage means 28. The bow 42 and the pod 44 are mounted with the ability to rotate so as to dictate the pitch of the assembly A.

The balancing means 26 comprise a twister 46, for example a four-pulley twister.

The storage means 28 here comprise a spool 48 for storing the assembly A.

Figure 2:
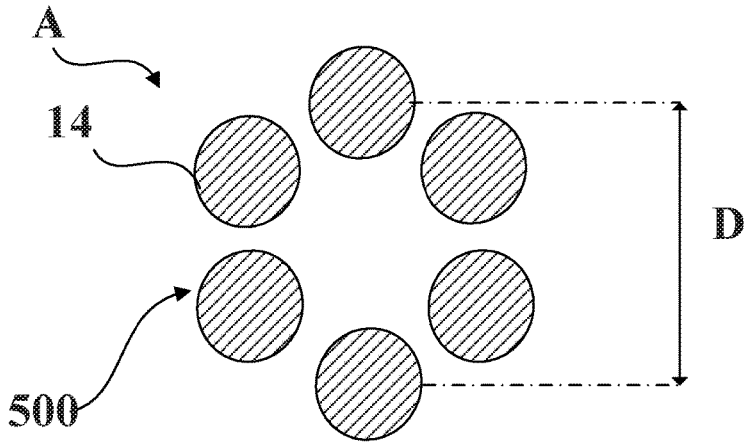
FIG. 2 is a view in section perpendicular to the axis of the assembly (presumed to be rectilinear and at rest) of an assembly produced by means of the unit of FIG. 1.
Figure 3:
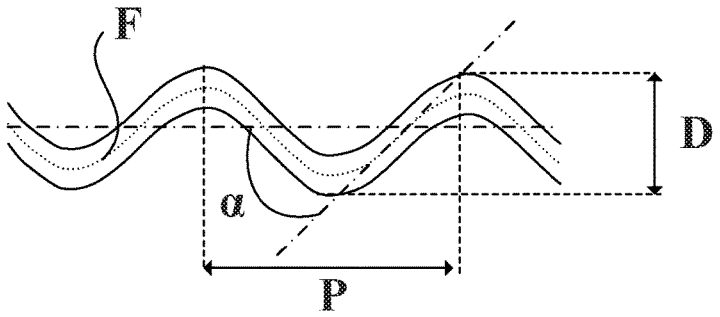
FIG. 3 is a view of a thread of the assembly of FIG. 2, projected onto a plane parallel to the axis of the assembly.

FIGS. 2 and 3 depict the assembly A according to the first embodiment of the invention, produced by means of the unit of FIG. 1.

The assembly A comprises, here consists of, a single layer 500 formed of the M filamentary elements of the assembly. The M filamentary elements are wound together in a helix. The layer 500 comprises between 2 and 9 filamentary elements 14. In this instance, the layer 500 comprises, here consists of, M filamentary elements 14 (M=6). The assembly A of FIG. 2 has no central core.

Each filamentary element 14 comprises, here consists of, a single metallic elementary monofilament of circular cross section, in this instance made of carbon steel, having a diameter ranging from 0.05 mm to 0.50 mm, preferably ranging from 0.10 mm to 0.40 mm, and more preferably from 0.15 mm to 0.35 mm, and in this instance equal to 0.26 mm.

The assembly A has a structural elongation greater than or equal to 2.0% measured in accordance with the standard ASTM A931-08. Advantageously, it has a structural elongation greater than or equal to 3.0%, preferably 4.0%, and more preferably 5.0%, measured in accordance with standard ASTM A931-08.

Each thread 14 is preformed using the individual-preforming means 18. Each thread 14 follows a path in the form of a three-dimensional helix characterized by a helix angle $\alpha$, a helix pitch P and a helix diameter D.

As illustrated in FIG. 3, the helix angle $\alpha$ is equal, in a plane of projection of the helix through which the longitudinal axis thereof passes, to the angle measured between the projection of the longitudinal axis onto the plane of projection and the tangent to the projection of the helix at the point of intersection of the projection of the helix and of the projection of the longitudinal axis. The helix angle $\alpha$ of each filamentary element 14 is comprised between 10° and 25°.

As illustrated in FIGS. 2 and 3, the helix diameter D is equal to the diameter of the circle described by the neutral axis F of each filamentary element 14. The helix diameter D can also be determined as being equal to the distance separating the centers of two filamentary elements that are diametrically opposed within the assembly A. The diameter D of the helix of each filamentary element 14 is such that $D=k2 \cdot d$ in which d is the diameter of each filamentary element 14, with k2 ranging from 2 to 5.

As illustrated in FIGS. 2 and 3, the helix pitch P is equal to the distance, along the axis of the filamentary element, that is covered by a point on the neutral axis F of the filamentary element after it has made one complete turn of the circle described by the neutral axis F. The helix pitch P of at least each first and second filamentary element 14 is such that $P=k1 \cdot d$ in which d is the diameter of each filamentary element 14, with k1 ranging from 15 to 50.

The assembly A is notably used in a tire and more preferably in the protective or hooping plies of tires such as described hereinabove.

A method of producing the assembly A according to a first embodiment, using the unit 10, will now be described.

First of all, the filamentary elements 14 are paid out individually from the feed means 12, in this instance the spools 30.

Next, the method comprises a step of individually twisting each filamentary element 14. Thus, each filamentary element 14 is twisted individually and separately with respect to the others. The step of individually twisting the filamentary elements 14 is performed using the twisters 32. During this twisting step, each filamentary element 14 is made to experience twisting about its own axis, then each filamentary element 14 is twist-balanced. After the individual-twisting step, each filamentary element 14 is therefore twisted and twist-balanced.

Next, the method comprises a step of individually preforming each previously-twisted filamentary element 14 into a helix. Thus, each previously-twisted filamentary element 14 is preformed individually and separately with respect to the others. The step of individually preforming the filamentary elements 14 is performed using the preformers 34.

Next, the method comprises a step of assembling the twisted and preformed filamentary elements 14 with one another to form the assembly A of filamentary elements 14. The assembly step is performed using the distributor 36, the assembly guide 38, but also using means arranged downstream of the assembly guide 38, which are the bow 42 and the pod 44.

Next, the method comprises a step of maintaining the rotation of the assembly A about its direction of travel. This step of maintaining the rotation is achieved by virtue of the twister 40.

The method then also comprises a step of balancing the assembly A. This balancing step is performed downstream of the step of assembly using the twister 46.

Finally, the assembly A is stored in the storage spool 48.

Figure 5:
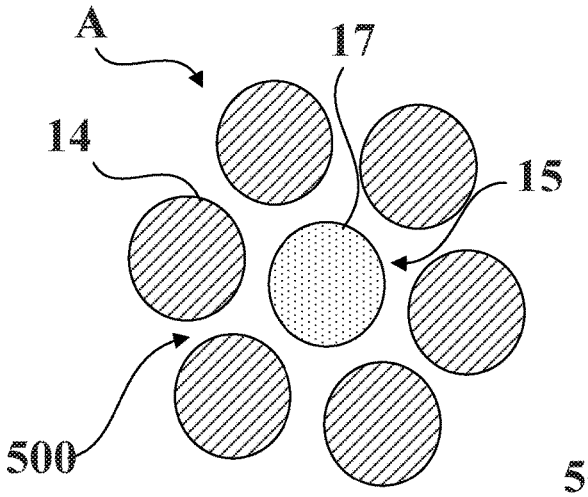
FIG. 5 is a view in section perpendicular to the axis of the assembly (presumed to be rectilinear and at rest) of an assembly produced by means of the unit of FIG. 4.
Figure 4:
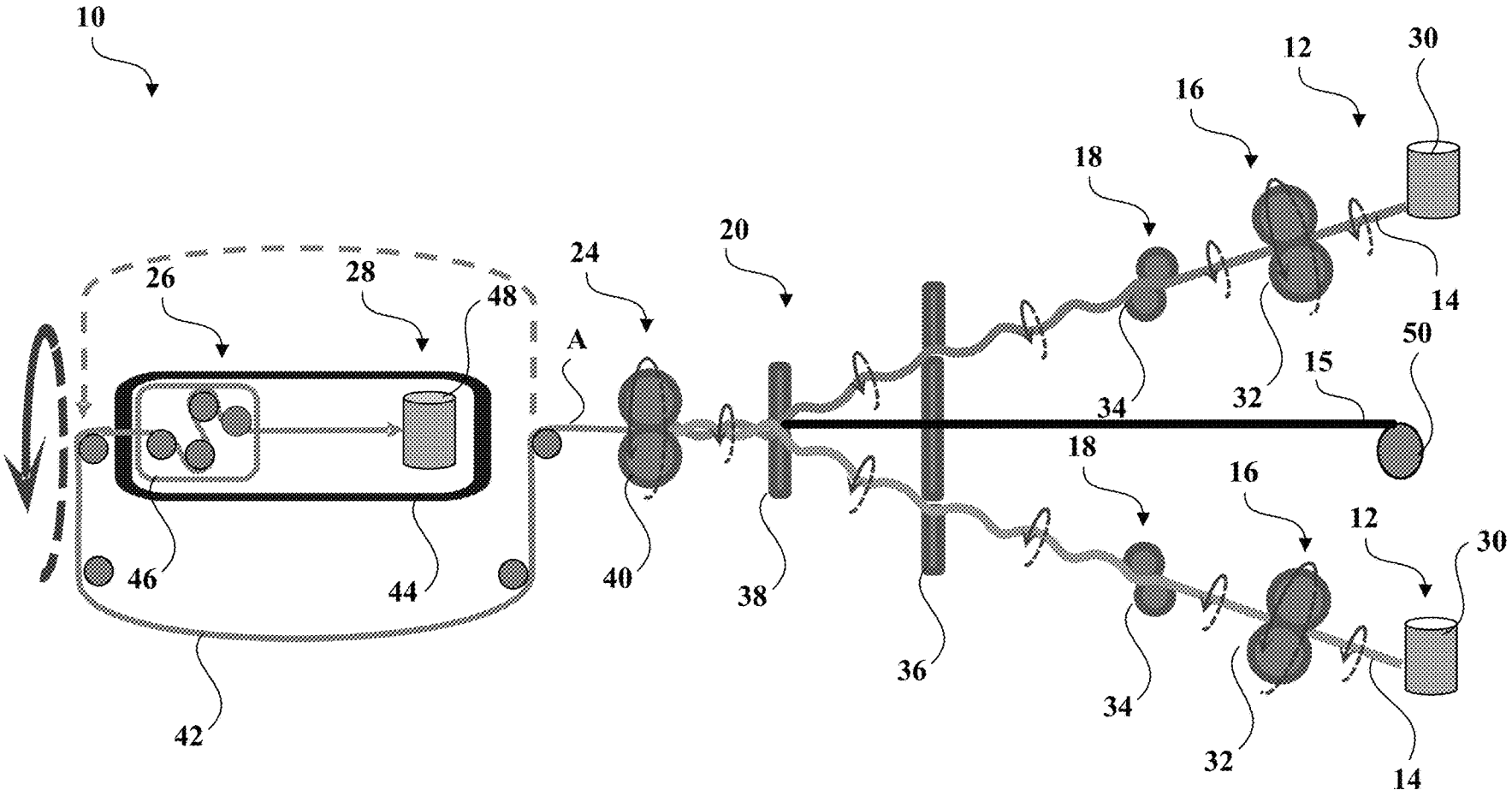
FIG. 4 is a diagram of a unit according to a second embodiment of the invention and making it possible to implement a method according to a second embodiment and to produce the assembly of FIG. 5.

FIGS. 4 and 5 illustrate a unit according to the invention and an assembly A both in accordance with a second embodiment. Elements analogous with those depicted in FIGS. 1 to 3 are denoted by identical references.

Unlike in the first embodiment, the unit of FIG. 4 comprises, in addition to the means 12 of storing the filamentary elements 14, means 50 for feeding in a central core 15.

Thus, as illustrated in FIG. 5, the assembly A comprises here consists of, a layer of M filamentary elements wound together in a helix around the central core 15 comprising N textile filamentary element(s) 17. The assembly A here is such that M=6 and N=1. As an alternative it is possible to conceive of N>1, for example N=2 or 3.

Each textile filamentary element 17 here comprises several multifilament strands, each one referred to as an overtwist, each one comprising several elementary monofilaments and assembled together in a helix to form a plied yarn. The elementary monofilaments are textile, in this instance made of PET.

Unlike in the method according to the first embodiment, the assembly step is a step of assembling the filamentary elements 14 and the central core 15. The assembly step is performed in such a way that the central core 15 exhibits a substantially non-zero twist. This twist is substantially equal to the twist imposed by the bow 42, the feed means 50 being stationary with respect to the assembly guide 38.

Figure 7:
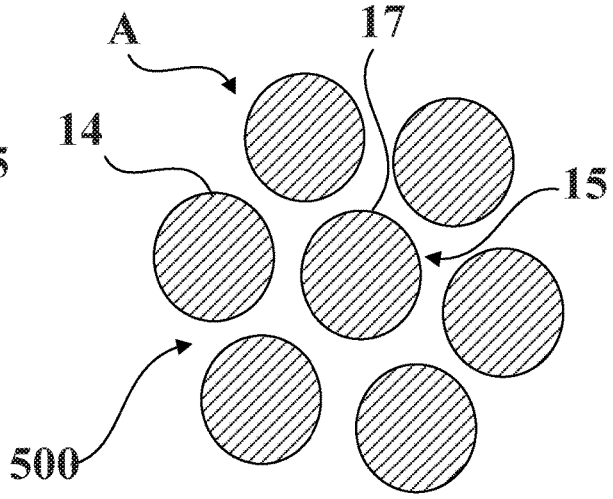
FIG. 7 is a view in section perpendicular to the axis of the assembly (presumed to be rectilinear and at rest) of an assembly according to a third embodiment produced by means of the unit of FIG. 6.
Figure 6:
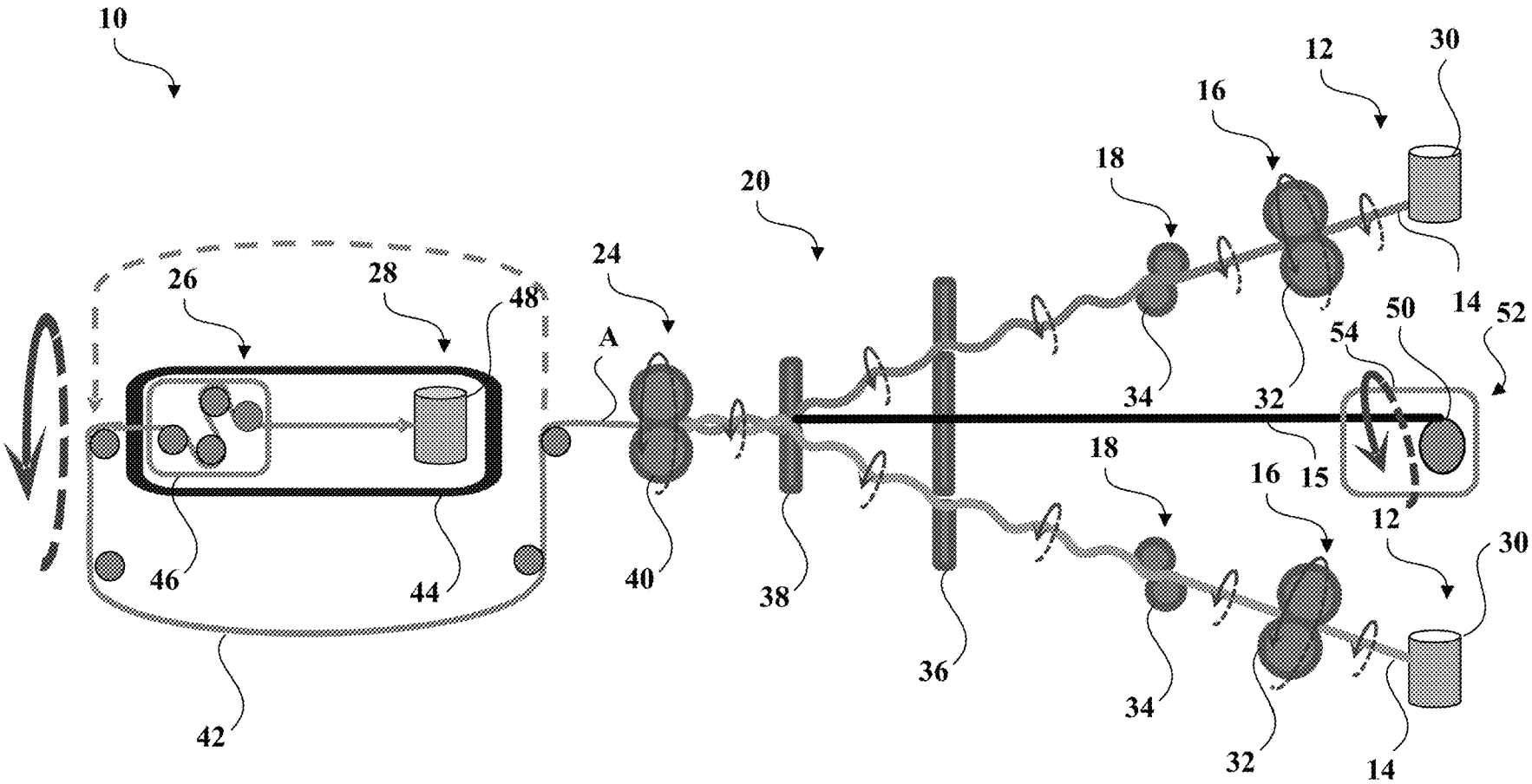
FIG. 6 is a diagram of a unit according to a third embodiment of the invention and making it possible to implement a method according to a third embodiment and to produce the assembly of FIG. 7.

FIGS. 6 and 7 illustrate a unit according to the invention and an assembly A both in accordance with a third embodiment. Elements analogous with those depicted in the preceding figures are denoted by identical references.

Unlike in the second embodiment, the unit of FIG. 6 comprises, in addition to the means 50 for feeding the central core 15, means 52 of rotating the means 50. In this particular instance, these rotation means comprise a pod 54.

Thus, as illustrated in FIG. 7, the assembly A comprises, here consists of, a layer of M filamentary elements wound together in a helix around the central core 15 comprising N metallic filamentary element(s) 17. The assembly A here is such that M=6 and N=1. As an alternative it is possible to conceive of N>1, for example N=2 or 3.

Each metallic and filamentary element 17 here is a metallic elementary monofilament, for example a steel thread with a diameter of between 0.05 mm and 0.50 mm, in this instance equal to 0.20 mm.

Unlike in the method according to the second embodiment, the assembly step is performed in such a way that the central core 15 exhibits substantially zero twist. This substantially zero twist is obtained by synchronizing the rotation of the bow 42 with the rotation of the feed means 50.

The invention is not limited to the embodiments described above.

Indeed, it is possible to envisage exploiting the invention with filamentary elements each comprising several metallic elementary monofilaments. Each filamentary element is then made up of a strand comprising the metallic elementary monofilaments. Once assembled, the filamentary elements or strands form a multi-strand rope.

The invention claimed is:

1. An apparatus for producing an assembly of filamentary elements wound together in a helix around a central core, the apparatus comprising:

a twisting device structured to twist a plurality of filamentary elements individually, so that at least a first filamentary element is twisted separately from a second filamentary element, to produce a plurality of twisted filamentary elements that are separate from one another;

a preforming device arranged downstream of the twisting device, the preforming device being structured to preform each of the twisted filamentary elements individually, so that at least a first twisted filamentary element is preformed separately from a second twisted filamentary element, to produce a plurality of preformed helixes that are separate from one another;

an assembling device arranged downstream of the preforming device, the assembling device being structured to assemble together the preformed helixes around the central core, to produce the assembly of filamentary elements, in which the central core exhibits a non-zero twist; and a central core feeder, arranged upstream of the assembling device, that feeds the central core, which comprises a plurality of textile filamentary elements, to the assembling device, wherein where a diameter of each of the plurality of filamentary elements is d, and each of the plurality of preformed helixes has a helix angle $\alpha$, a helix pitch P, and a helix diameter D, the following conditions are satisfied:

$P=k1\times d$, where k1=15 to 50, $D=k2\times d$, where k2=2 to 5, and $\alpha$ is 10° to 25°.

2. The apparatus according to claim 1, further comprising a filamentary elements feeder arranged upstream of the twisting device, the feeder being structured to feed the filamentary elements to the twisting device.

3. The apparatus according to claim 1, wherein the plurality of filamentary elements comprises six filamentary elements, each having a diameter of 0.15 to 0.35 mm, and wherein the assembly of filamentary elements has a structural elongation of greater than or equal to 3.0% as measured in accordance with ASTM A931-08.

4. The apparatus according to claim 1, wherein each of the plurality of filamentary elements has a circular cross-section, and wherein the assembly of filamentary elements has a structural elongation of greater than or equal to 5.0% as measured in accordance with ASTM A931-08.

5. The apparatus according to claim 1, wherein the assembling device includes a distributor and an assembly guide.

6. The apparatus according to claim 5, further comprising a filamentary elements feeder arranged upstream of the twisting device, the feeder being structured to feed the filamentary elements to the twisting device.

7. The apparatus according to claim 5, further comprising a rotation maintaining device arranged downstream of the assembly guide, the rotation maintaining device being structured to maintain a rotation of the assembly of filamentary elements.

8. The apparatus according to claim 7, wherein the assembling device includes a bow positioned downstream of the assembly guide.

9. The apparatus according to claim 8, wherein the assembling device includes a pod arranged downstream of the assembly guide, the pod including a storage device structured to store the assembly of filamentary elements.

10. The apparatus according to claim 9, wherein the pod includes a balancer structured to balance the assembly of filamentary elements, the balancer comprising a twister.

11. The apparatus according to claim 7, wherein the assembling device includes a pod arranged downstream of the assembly guide, the pod including a storage device structured to store the assembly of filamentary elements.

12. The apparatus according to claim 11, wherein the pod includes a balancer structured to balance the assembly of filamentary elements, the balancer comprising a twister.

13. The apparatus according to claim 7, further comprising a filamentary elements feeder arranged upstream of the twisting device, the feeder being structured to feed the filamentary elements to the twisting device.

14. The apparatus according to claim 5, wherein the assembling device includes a bow positioned downstream of the assembly guide.

15. The apparatus according to claim 14, wherein the assembling device includes a pod arranged downstream of the assembly guide, the pod including a storage device structured to store the assembly of filamentary elements.

16. The apparatus according to claim 15, wherein the pod includes a balancer structured to balance the assembly of filamentary elements, the balancer comprising a twister.

17. The apparatus according to claim 14, further comprising a filamentary elements feeder arranged upstream of the twisting device, the feeder being structured to feed the filamentary elements to the twisting device.

18. The apparatus according to claim 5, wherein the assembling device includes a pod arranged downstream of the assembly guide, the pod including a storage device structured to store the assembly of filamentary elements.

19. The apparatus according to claim 18, wherein the pod includes a balancer structured to balance the assembly of filamentary elements, the balancer comprising a twister.

20. The apparatus according to claim 19, further comprising a filamentary elements feeder arranged upstream of the twisting device, the feeder being structured to feed the filamentary elements to the twisting device.

21. The apparatus according to claim 18, further comprising a filamentary elements feeder arranged upstream of the twisting device, the feeder being structured to feed the filamentary elements to the twisting device.

22. An apparatus for producing an assembly of filamentary elements wound together in a helix around a central core, the apparatus comprising:

a twisting device structured to twist a plurality of filamentary elements individually, so that at least a first filamentary element is twisted separately from a second filamentary element, to produce a plurality of twisted filamentary elements that are separate from one another;

a preforming device arranged downstream of the twisting device, the preforming device being structured to preform each of the twisted filamentary elements individually, so that at least a first twisted filamentary element is preformed separately from a second twisted filamentary element, to produce a plurality of preformed helixes that are separate from one another;

an assembling device arranged downstream of the preforming device, the assembling device being structured to assemble together the preformed helixes around the central core, to produce the assembly of filamentary elements; and a central core feeder, arranged upstream of the assembling device, that feeds the central core, which comprises a plurality of textile filamentary elements, to the assembling device, wherein where a diameter of each of the plurality of filamentary elements is d, and each of the plurality of preformed helixes has a helix angle $\alpha$, a helix pitch P, and a helix diameter D, the following conditions are satisfied:

$P=k1\times d$, where $k1=15$ to 50, $D=k2\times d$, where $k2=2$ to 5, and $\alpha$ is 10° to 25°, wherein the assembling device includes a pod arranged downstream of the assembly guide, the pod including a storage device structured to store the assembly of filamentary elements, wherein the pod includes a balancer structured to balance the assembly of filamentary elements, the balancer comprising a twister, and wherein the pod and the central core feeder rotate synchronously around an axis, extending from the central core feeder to the assembling device, along which the central core feeder feeds the central core.

* * * * *